US005769446A

United States Patent [19]

Borsoi

[11] Patent Number: 5,769,446

[45] Date of Patent: Jun. 23, 1998

[54] BINDING WITH IMPROVED FIT

[75] Inventor: Bruno Borsoi, Vittorio Veneto, Italy

[73] Assignee: Nordica S.p.A., Trevignano, Italy

[21] Appl. No.: 660,357

[22] Filed: Jun. 7, 1996

[30] Foreign Application Priority Data

Jun. 21, 1995 [IT] Italy ..... TV950037 U

[51] Int. Cl.[6] ..... A63C 9/00

[52] U.S. Cl. ..... 280/623; 280/14.2; 441/70

[58] Field of Search ..... 280/14.2, 11.12, 280/600, 611, 623, 11.31, 11.3, 11.19; 441/70

[56] References Cited

U.S. PATENT DOCUMENTS 5,261,689 11/1993 Carpenter et al. ..... 280/618

5,480,176 1/1996 Sims ..... 280/14.2 X

FOREIGN PATENT DOCUMENTS 1905440 11/1969 Germany ..... 280/611

9113766 2/1992 Germany .

9519205 7/1995 WIPO .

*Primary Examiner*—F. J. Bartuska

*Attorney, Agent, or Firm*—Guido Modiano; Albert Josif

[57] ABSTRACT

A binding for snowboards constituted by a plate having side walls and a rear cuff. Straps are selectively associated transversely with respect to the side walls of the plate, to adjust the fit of a shoe arranged between the side walls.

13 Claims, 3 Drawing Sheets

BINDING WITH IMPROVED FIT

BACKGROUND OF THE INVENTION

The present invention relates to a binding with improved fit, particularly for sports shoes for snowboarding or for other sports such as skating, cross-country skiing, Telemark skiing, water skiing, or windsurfing.

To use the snowboard, in particular, it is necessary to bind a boot, or a shoe, to the sports implement, which is generally constituted by a board, by means of an appropriate binding that allows the user to steer the board.

The binding used to practice snowboarding is marketed in a single size, or in a limited number of two or three sizes, and it is essentially constituted by a plate that is fixed to the board by means of screws and has a preset width. Lateral walls protrude along the perimeter of the plate, and belts or straps are associable with the side walls by means of screws and bolts and can be mutually fastened for example by means of levers. A cuff for the rear support of the shoe is also rotatably associated with the walls in a rearward region.

However, these conventional bindings have some drawbacks; if the user has a small-size shoe, empty spaces are left laterally between the shoe and the side walls of the plate. These empty spaces cause, during sports practice, a relative motion between the shoe and the board that causes considerable difficulty in steering the board due to the delay in the transmission of the impulses from the shoe to the board.

In addition to this technical aspect, further fatigue of the user is caused by the broader movements required to control the board.

If instead the user has a shoe whose size is large with respect to the plate of the binding, it is obviously difficult to accommodate the shoe.

In both of the above mentioned cases, the best condition for skiing and control of the sports implement does not occur.

As a partial solution to these problems, bindings are known that have two separate L-shaped plates at the walls where the belts or levers are fixed.

However, these bindings, too, have drawbacks; the lack of the base plate, which connects the two L-shaped plates, causes the binding to be less structured and thus ensure looser securing of the shoe to the board with consequent lower precision in the user's steering of said board.

All this is confirmed by the fact that these bindings are aimed at a field, such as the one known as "freestyle", that does not require the same precision and securing of the shoe or boot in steering the board. It has in fact been observed that the coupling of the two L-shaped plates to the board can loosen during use, owing to the presence of slots, instead of holes, that are formed on one of the wings of the two plates.

In turn, the seats formed on the board must be provided with metal elements so that the screws can withstand the tensions that are produced during sports practice, as the resistance of wood, of which the board is made, to this kind of stress is poor.

It is also known that an increase in the number of holes on the board to adapt the dimensions of the binding to the dimensions of the shoe or boot causes a decrease in the ability of the board to withstand torsion and flexing, both of which are stresses that occur during sports practice.

Another drawback that occurs in conventional plate-like bindings is linked to the several types of vibration to which the board and the binding are subjected during sports practice; these stresses irreparably affect the binding coupling screws.

The loosening and tightening of the screws to modify the settings of the binding and the continuous effects of the vibrations may cause the accidental loosening or even failure of the screws, with severe danger for the user, who would lose control of the board.

Conventional solutions therefore allow an adjustment between the size of the shoe and the dimension of the binding, but in a structurally complicated and troublesome manner, which also increases the stresses on the mechanical parts, which are already intensely stressed. Finally, these solutions are limited to a particular discipline of snowboarding, namely freestyle, which is practiced by a very small number of users.

DE-U-9113766, for example, discloses a binding for snowboards which provides for a limited adaptation to different shoe sizes by means of straps connected to the base plate through sliders.

SUMMARY OF THE INVENTION

The aim of the present invention is to solve the mentioned technical problems, eliminating the drawbacks of the mentioned art by providing a device that allows, in sports disciplines such as snowboarding, to achieve optimum mutual adaptation of the shoe and of the binding associated with the board.

Within the scope of the above aim, an object is to provide a device that allows to achieve optimum positioning of the shoe or boot on the binding, increasing the user's sensitivity in steering the board.

Another object is to provide a device that associates with the above characteristics that of being usable in boards for which the technical and structural characteristics can be left unchanged.

Another object is to provide a device that allows to reduce user fatigue.

Another object is to provide a device that is structurally simple and can be actuated by the user at any time, the degree of tightening of the screws for connecting the plate and the board being unchanged, so as to maintain high safety conditions during sports practice.

Another object is to provide a device that has low costs and can be manufactured with conventional machines and equipment.

This aim, these objects, and others which will become apparent hereinafter are achieved by a binding with improved fit, particularly for snowboarding, comprising a plate associable with a snowboard and having side walls, said plate being adapted to accommodate a shoe between said side walls, characterized in that it comprises fastening means that have, at their ends, at least one engagement means that can be selectively associated transversely with respect to said side walls of said plate.

BRIEF DESCRIPTION OF THE DRAWINGS

Further characteristics and advantages of the invention will become apparent from the description of a preferred but not exclusive embodiment of the device, illustrated only by way of non-limitative example in the accompanying drawings, wherein.

DESCRIPTION OF THE PREFERRED EMBODIMENTS

Figure 1:
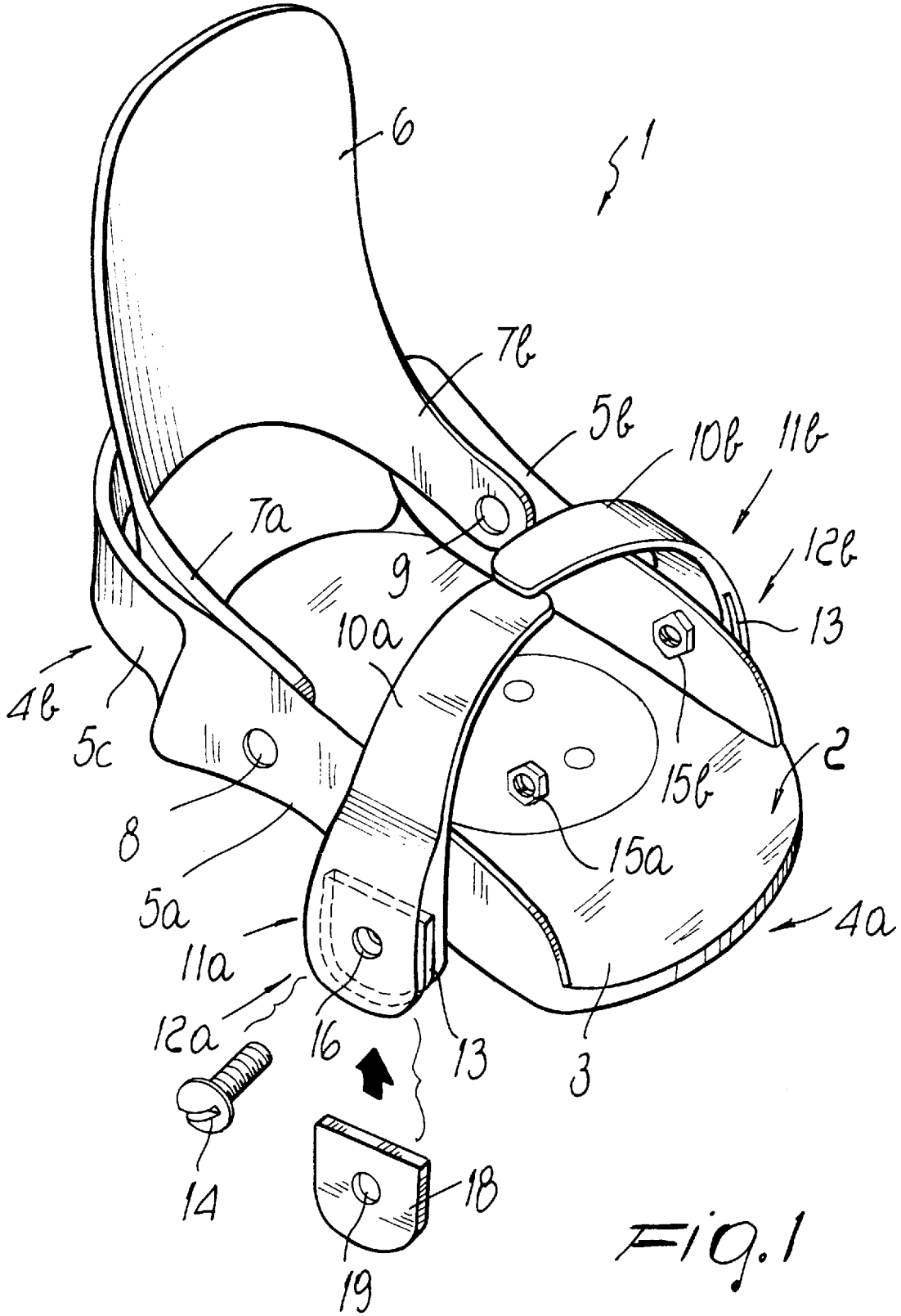
FIG. 1 is a lateral perspective exploded view of the binding according to the invention.

With reference to the above figures, the reference numeral 1 designates a binding for sports shoes, particularly for snowboarding.

Binding 1 is constituted by a plate 2 fixed to a snowboard deck that is not shown in the figure.

Plate 2 is constituted by a substantially rectangular and flat base 3 that has a first front region 4*a* and a second rear region 4*b*, both of which are rounded.

A first side wall 5*a* and a second side wall 5*b* protrude along the perimeter of plate 2 in an upward region and at least at the longitudinal edges. The walls are connected by a third rear wall 5*c* that lies above second region 4*b* of the plate.

A cuff 6 is rotatably associated with the first and second side walls of plate 2, at rear region 4*b*, and is shaped so as to be arranged adjacently inside third wall 5*c* and protrude above the third wall.

Cuff 6 in fact has a first arm 7*a* and a second arm 7*b*, whose ends are associated with first side wall 5*a* and with second side wall 5*b*, respectively, by means of a first pivot 8 and a second pivot 9 that are accommodated in appropriate first and second holes formed on the first and second side walls.

At least a first fastening means 10*a* and a second fastening means 10*b* are also detachably associable with plate 2. The fastening means are adapted to allow to fix the shoe or the shell of the boot, not shown in the figure, of the user.

First fastening means 10*a* and second fastening means 10*b* are constituted by two belts or straps, having lower end 11*a* and 11*b* provided with at least a first engagement means and a second engagement means, designated by the reference numerals 12*a* and 12*b*, that respectively allow connection to first side wall 5*a* and to second side wall 5*b*.

First and second engagement means 12*a* and 12*b* are constituted by at least two tabs, between which at least one first seat or slot 13 is formed. Third holes 16, having the same axis, are formed on the tabs.

First and second engagement means 12*a* and 12*b* can be connected to first and second side walls 5*a* and 5*b* by means of a pair of fixing screws 14 that can be locked by means of a pair of nuts 15*a* and 15*b*. The stems of the screws pass at third holes 16 and at fourth holes 17 that are formed on first and second side walls 5*a* and 5*b*.

Advantageously, engagement means 12*a* and 12*b* also comprise an insert 18 that is shaped complementarily to first seat or slot 13 and can be removably arranged thereat. The insert has a fifth hole 19 that has the same axis as third holes 16 once it is interposed between the tabs.

Figure 2:
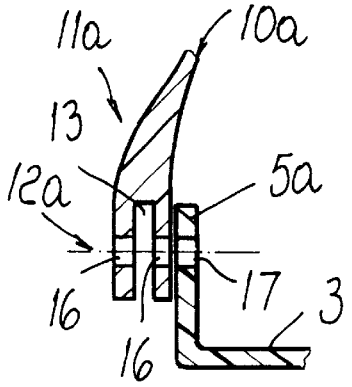
FIGS. 2 to 4 are partial cross section views of the binding in three different conditions of activation.
Figure 3:
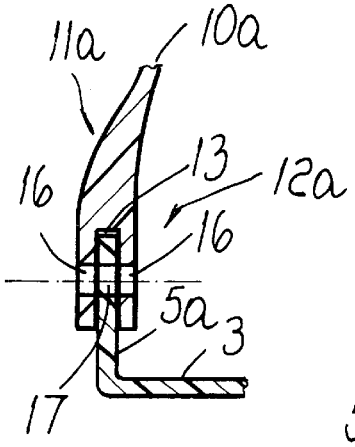
Figure 4:
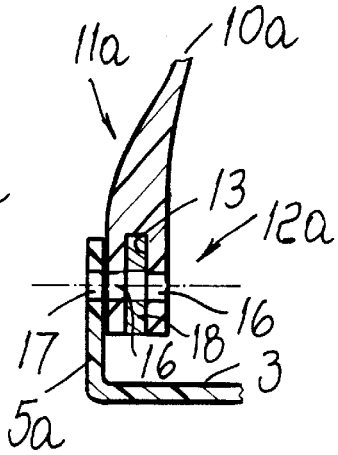
Figure 5:
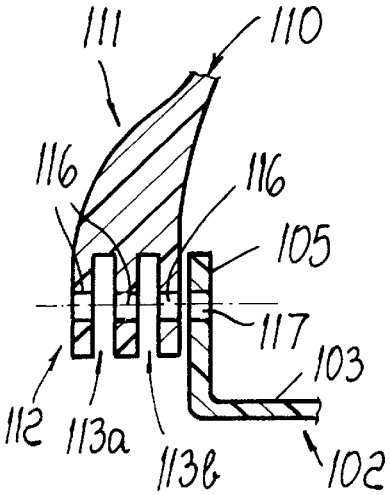
FIGS. 5 to 8 are views, similar to the preceding ones, of a further embodiment of the engagement means according to the invention.
Figure 6:
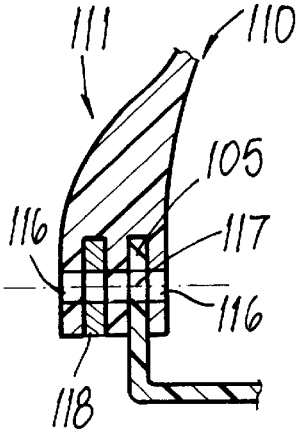
Figure 7:
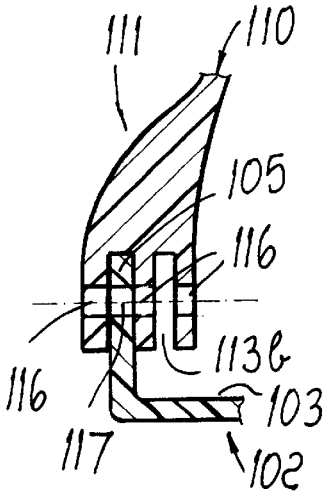
Figure 8:
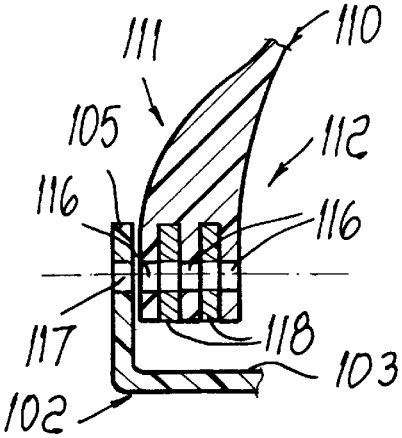
Figure 9:
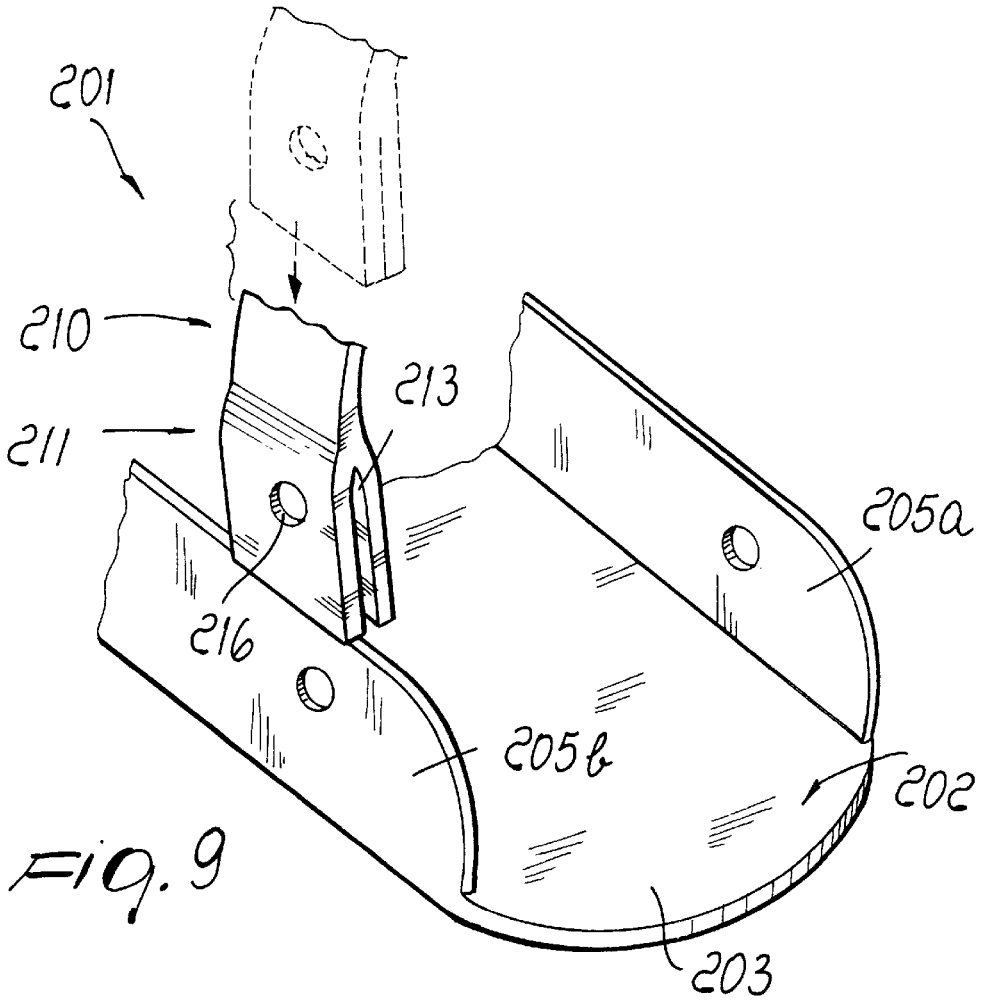
FIG. 9 is a view, similar to FIG. 1, of still a further embodiment of the engagement means.
Figure 10:
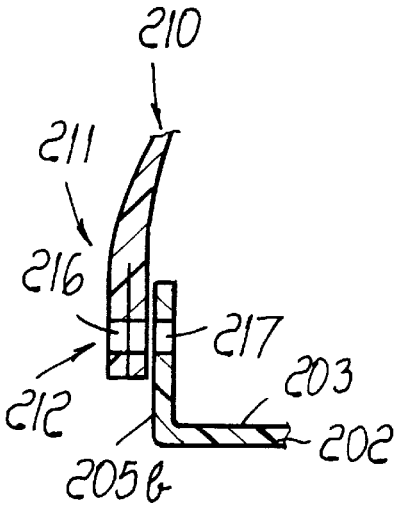
FIG. 10 to 12 are views, similar to FIG. 2, of the different activation conditions of the device of FIG. 9.
Figure 11:
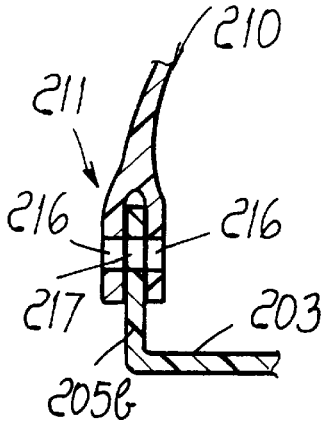
Figure 12:
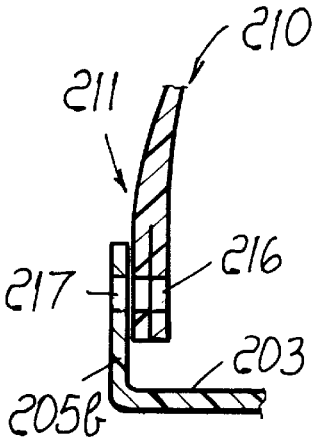

The use of the invention is as follows: first and second fastening means 12*a* and 12*b* can be associated with first and second side walls 5*a* and 5*b* in three different manners, as shown in FIGS. 2 to 4.

If lower ends 11*a* and 11*b* are arranged inside or outside first and second side walls 5*a* and 5*b*, insert 18 must advantageously be inserted at first seat 13, so as to avoid the deformation or breakage of the tabs that constitute engagement means 12*a* and 12*b* when the pair of screws 14 is locked.

If lower ends 11*a* and 11*b* instead straddle first and second side walls 5*a* and 5*b*, so as to interpose the side walls between the tabs that constitute engagement means 12*a* and 12*b*, insert 18 do not need to be used or can optionally be arranged outside the first or second fastening means.

It has thus been observed that the device thus conceived has achieved the intended aim and objects, since the above described optional different arrangement of the lower ends of the tabs allows to determine, transversely to the plate, the amount of space that must be recovered to achieve adequate accommodation of the shoe or boot inside the binding.

The possibility of forming fourth holes 17 in the desired point of first and second side walls 5*a* and 5*b*, together with the fact of using a desired number of belts or straps that constitute the first and second fastening means, allows to accommodate in the binding various sizes of shoes or boots without having to make holes in the board, which can thus preserve intact its technical and physical characteristics.

The elimination of the plays between the shoe and the binding also allows to eliminate the delay in the transmission of the forces between them, thus increasing the sensitivity of the control of the board and reducing the fatigue of the user during sports practice.

The device thus conceived is susceptible of numerous modifications and variations, all of which are within the scope of the same inventive concept.

Thus, for example, FIGS. 5 to 8 illustrate a further embodiment of the adapter, which comprises a plate 102 from the base 103 of which first and second side walls 105 protrude upward and at least at the longitudinal edges.

At least a first and a second fastening means 110 are detachably associable with plate 102 and are constituted by one or more pairs of belts or straps, at the lower end 111 of which there are at least a first and a second engagement means 112, which are constituted by at least one pair of tabs, between which at least two first seats 113*a* and 113*b* are formed. Third holes 116 are formed on the pair of tabs, have the same axis, and can be arranged at fourth holes 117 formed on first and second side walls 105.

In this case it is advantageously possible to use one or two inserts 118 that can be inserted in one or both of the first seats 113*a* and 113*b*, depending on the arrangement of the lower ends 111 of first and second fastening means 110.

Engagement means 112 can in fact either be arranged adjacently inside or outside first and second side walls 105 or can be coupled to them by inserting first and second side walls 105 either in first seat 113*a* or in second seat 113*b*. In the first two cases it is possible to use two inserts 118 that are inserted in both of first seats 113*a* and 113*b*, whereas in the second two cases a single insert 118 is used and is inserted in one of the two first seats 113*a* and 113*b* that is not affected by first and second side walls 105.

FIGS. 9 to 12 illustrate still a further embodiment of the adapter 201, which comprises a plate 202 from the base 203 of which a first side wall 205*a* and a second side wall 205*b* protrude upward and at least at the longitudinal edges.

At least a first and a second fastening means 210 are detachably associable with plate 202 and are constituted by one or more pairs of belts or straps, at the lower end 211 of which at least a first and a second engagement means 212 are formed. The engagement means are constituted by at least two tabs forming a slot. The tabs can be spaced elastically so as to form a first seat 213 between them for first and second side walls 205*a* and 205*b*.

Third holes 216 are formed on the two tabs, have the same axis, and can be arranged at fourth holes 217 that are formed on the first and second side walls 205*a* and 205*b*.

These solutions, too, allow to achieve the intended aim and objects, since by means of the user-selectable positioning of the lower ends of the above described tabs with respect to the first and second side walls it is possible to determine, transversely to the plate, the amount of space to be recovered to achieve adequate seating of the shoe or boot inside the binding.

In this last case it is not necessary to provide the insert that can be interposed in seat 213, since first and second engagement means 212 are mutually adjacent once the screws are locked and, by virtue of the shape of ends 211, are less likely to break.

The materials and the dimensions that constitute the individual components of the device may of course also be the most pertinent according to the specific requirements.

What is claimed is:

1. A binding with improved fit, particularly for snowboarding, comprising a plate associable with a snowboard and having side walls, said plate being adapted to accommodate a shoe between said side walls, the binding further comprising fastening means that have ends, and at said ends at least one engagement means that can be selectively associated transversely with respect to said side walls of said plates said engagement means comprising at least one pair of tabs, between which at least one first seat or slot is formed, holes having the same axis being provided on said at least one pair of tabs.

2. The binding according to claim 1, wherein said fastening means is detachably associated with said plate, said fastening means being constituted by two belts or straps at the lower end of which said engagement means being adapted to allow a connection to said side walls respectively with a compensation of the useful transverse space for said shoe obtainable between said side walls, said compensation being variable in more than two positions and presettable.

3. The binding according to claim 1, wherein it comprises two fixing screws that can be locked by means of a pair of nuts, the stems of said screws passing at said third holes and at fourth holes formed on said side walls.

4. The binding according to claim 3, wherein said engagement means comprises one or more inserts that are shaped complementarily to said at least one first seat and can be positioned thereat, said one or more inserts having a fifth hole that has the same axis as said third holes once said inserts are interposed between said tabs.

5. The binding according to claim 4, wherein said engagement means can be either arranged adjacently inside or outside said side walls, inserting said side walls in said at least one first seat.

6. The binding according to claim 1, wherein said engagement means is constituted by at least one pair of tabs, between which at least two first seats are formed.

7. The binding according to claim 6, wherein said engagement means can either be arranged adjacently inside or outside said side walls by inserting said side walls in one of said first seats.

8. The binding according to claim 7, wherein if said engagement means is arranged adjacently inside or outside said side walls, two inserts can be positioned in said at least two first seats.

9. The binding according to claim 1, wherein if said engagement means is coupled to said first and second side walls, a single insert is used and is inserted in the one of said two first seats that is not affected by said side walls.

10. The binding according to claim 1, wherein said engagement means comprises at least two tabs forming a slot, and wherein said tabs can be spaced apart elastically to obtain, between them, a first seat for said side walls.

11. The binding according to claim 11, wherein third holes are formed on said two tabs, have the same axis, and can be arranged at fourth holes formed on said side walls.

12. The binding according to claim 1, further comprising a cuff rotatably associated to the rear of said plate.

13. A binding with improved fit, particularly for snowboarding, comprising a plate associable with a snowboard and having side walls, said plate being adapted to accommodate a shoe between said side walls, the binding further comprising a fastening device that have ends, and at said ends at least one engagement device that can be selectively associated transversely with respect to said side walls of said plate, said engagement device comprising at least one pair of tabs, between which at least one first seat or slot is formed, holes having the same axis being provided on said at least one pair of tabs.

* * * * *